US010359044B2

(12) United States Patent
Kawano et al.

(10) Patent No.: US 10,359,044 B2
(45) Date of Patent: Jul. 23, 2019

(54) COMPRESSOR SYSTEM

(71) Applicant: Powerex-Iwata Air Technology, Inc., Harrison, OH (US)

(72) Inventors: Ryosuke Kawano, Yokohama (JP); Joseph Anton Abt, Harrison, OH (US)

(73) Assignee: Powerex/Scott Fetzer Company, Harrison, OH (US)

( * ) Notice: Subject to any disclaimer, the term of this patent is extended or adjusted under 35 U.S.C. 154(b) by 26 days.

(21) Appl. No.: 15/589,280

(22) Filed: May 8, 2017

(65) Prior Publication Data

US 2017/0321699 A1 Nov. 9, 2017

Related U.S. Application Data

(60) Provisional application No. 62/332,779, filed on May 6, 2016.

(51) Int. Cl.

| | |
|---|---|
| ***F04C 29/04*** | (2006.01) |
| ***F04C 18/02*** | (2006.01) |
| ***F04C 29/00*** | (2006.01) |
| ***F04C 29/12*** | (2006.01) |
| ***F28D 1/047*** | (2006.01) |
| ***F01C 21/00*** | (2006.01) |
| ***F04C 23/00*** | (2006.01) |
| ***F28F 1/32*** | (2006.01) |

(52) U.S. Cl.

CPC ..... *F04C 29/04* (2013.01); *F01C 21/007* (2013.01); *F04C 23/001* (2013.01); *F28D 1/0478* (2013.01); *F28F 1/32* (2013.01); *F04C 2240/30* (2013.01); *F04C 2240/70* (2013.01); *F04C 2240/806* (2013.01)

(58) Field of Classification Search

CPC .... F04C 29/04; F04C 23/001; F04C 2240/30; F04C 2240/70; F04C 2240/806; F01C 21/007; F28D 1/0477

See application file for complete search history.

(56) References Cited

U.S. PATENT DOCUMENTS

| | | | | |
|---|---|---|---|---|
| 6,077,052 | A * | 6/2000 | Gunn | F01P 7/12 417/297 |
| 8,035,972 | B2 * | 10/2011 | Ostwald | H05K 7/20781 165/80.4 |
| 8,113,009 | B2 * | 2/2012 | Kuriyama | H05K 7/20745 361/696 |
| 8,959,941 | B2 * | 2/2015 | Campbell | H05K 7/20145 165/104.33 |
| 9,051,934 | B2 * | 6/2015 | Fraser | F04C 29/021 |

(Continued)

*Primary Examiner* — Melvin Jones

(74) *Attorney, Agent, or Firm* — Tarolli, Sundheim, Covell & Tummino LLP; John A. Yirga, Esq.

(57) ABSTRACT

A compressor system is disclosed. The compressor system includes a motor, a compressor driven by the motor, a first after cooler, a second after cooler, and a heat exchanger housed in an enclosure. Interior panels are arranged in the enclosure to separate the motor and compressor, the first after cooler, the second after cooler, and the heat exchanger from one another. Conduit extends through the interior panels to provide a fluid path between the compressor, the first after cooler, the second after cooler, and the heat exchanger. Ducting is provided in the enclosure to provide fluid communication between various components of the compressor system.

20 Claims, 13 Drawing Sheets

(56) References Cited

U.S. PATENT DOCUMENTS

| | | | | |
|---|---|---|---|---|
| 2011/0026225 | A1* | 2/2011 | Ostwald | H05K 7/20645 361/699 |
| 2017/0218958 | A1 | 8/2017 | Seaver et al. | |

* cited by examiner

COMPRESSOR SYSTEM

CROSS-REFERENCE TO RELATED APPLICATIONS

The present application claims priority under 35 U.S.C. § 119(e) to U.S. Provisional Patent Application Ser. No. 62/332,779 filed May 6, 2016 entitled COMPRESSOR SYSTEM. The entire contents of the above-identified application of which priority is claimed is incorporated herein by reference in its entirety for all purposes.

FIELD OF THIS DISCLOSURE

The present disclosure relates to a compressor system. More specifically, the present disclosure relates to a gas compressor system having a three stage after cooling arrangement that substantially reduces the temperature of a gas after compression.

BACKGROUND

The use of gas compressors is known. When gas is compressed, heat is generated and the temperature of the gas being compressed is elevated. If the use of dryers is desired to remove moisture from the compressed gas, the temperature of the compressed gas must be reduced to an appropriate value before reaching the dryers.

One known way of reducing the temperature of a compressed gas is the use of an after cooler. After coolers can utilize air or water to facilitate cooling. In the case of an after cooler utilizing air, an arrangement for facilitating airflow over external surfaces of the after cooler must be provided. One common way of facilitating this airflow is the use of a fan.

It is known to arrange a fan to provide air flow for the compressor and also provide air flow for the after cooler. In the case of oilless scroll compressors, it is known to provide ducting so that the cooling air provided by the fan is first used to cool the compressor. Then, once the cooling air has cooled the compressor, the ducting conveys the now warmed cooling air over the after cooler. In this arrangement, the compressed gas can only be cooled to the temperature that the warmed cooling air has already reached during its usage as a compressor cooling medium. Although the arrangement of using the warmed cooling air is mechanically advantageous, there exists a performance limitation if it is desired for the compressed to be even cooler.

Additionally, if a cabinet is used for sound reduction, the temperature of the compressor cooling air is appreciably warmer as compared to a compressor system that is mounted in the open (e.g., without a sound reducing cabinet). Additionally, a compressor system that is mounted in the open is able to take advantage of useful cooling from general airflow around the compressor system, whereas the use of a sound reducing cabinet substantially reduces this type of cooling.

SUMMARY

One aspect of the present disclosure includes a compressor system comprising a plurality of panels attached to a frame to define an enclosure, a pump bay provided in the enclosure. The pump bay including a motor and a compressor driven by the motor. The compressor system further comprising interior panels defining the pump bay, a first cooling area comprising a first after cooler, a second cooling area comprising a second after cooler, and a third cooling area comprising a heat exchanger. The interior panels comprising ducting to fluidly connect at least one of the pump bay, the first cooling area, the second cooling area, and the third cooling area to each other.

Another aspect of the present disclosure includes a method of assembling a compressor system comprising the steps of attaching a plurality of panels to a frame to define an enclosure, arranging a plurality of interior panels in the enclosure to define a pump bay, a first cooling bay, a second cooling bay, and a third cooling bay, and providing a motor and a compressor driven by the motor in the pump bay. The method further comprises providing a first after cooler in the first cooling bay and fluidly coupling the first after cooler to the compressor, providing a second after cooler in the second cooling bay and fluidly coupling the first after cooler to the second after cooler, and providing a heat exchanger in the third cooling bay and fluidly coupling the heat exchanger to the second after cooler.

Yet another aspect of the present disclosure includes a compressor system having a frame and a plurality of panels attached to the frame to define an enclosure. A pump bay is provided in the enclosure. The pump bay includes a motor and a compressor driven by the motor. The compressor system further includes a first after cooler, a second after cooler, and a heat exchanger. Interior panels are arranged in the enclosure to separate the pump bay, the first after cooler, the second after cooler, and the heat exchanger. Conduit extends through the interior panels to provide a fluid path for compressed gas from the compressor, the first after cooler, the second after cool, and the heat exchanger. First ducting is provided in the enclosure. The first ducting is arranged to provide fluid communication between the pump bay and the first after cooler. Second ducting is provided in the enclosure. The second ducting is arranged to provide fluid communication between an interior space of the enclosure and the second after cooler. Third ducting is provided in the enclosure. The third ducting is arranged to provide fluid communication between an ambient environment external to the enclosure and the heat exchanger.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

Figure 1:
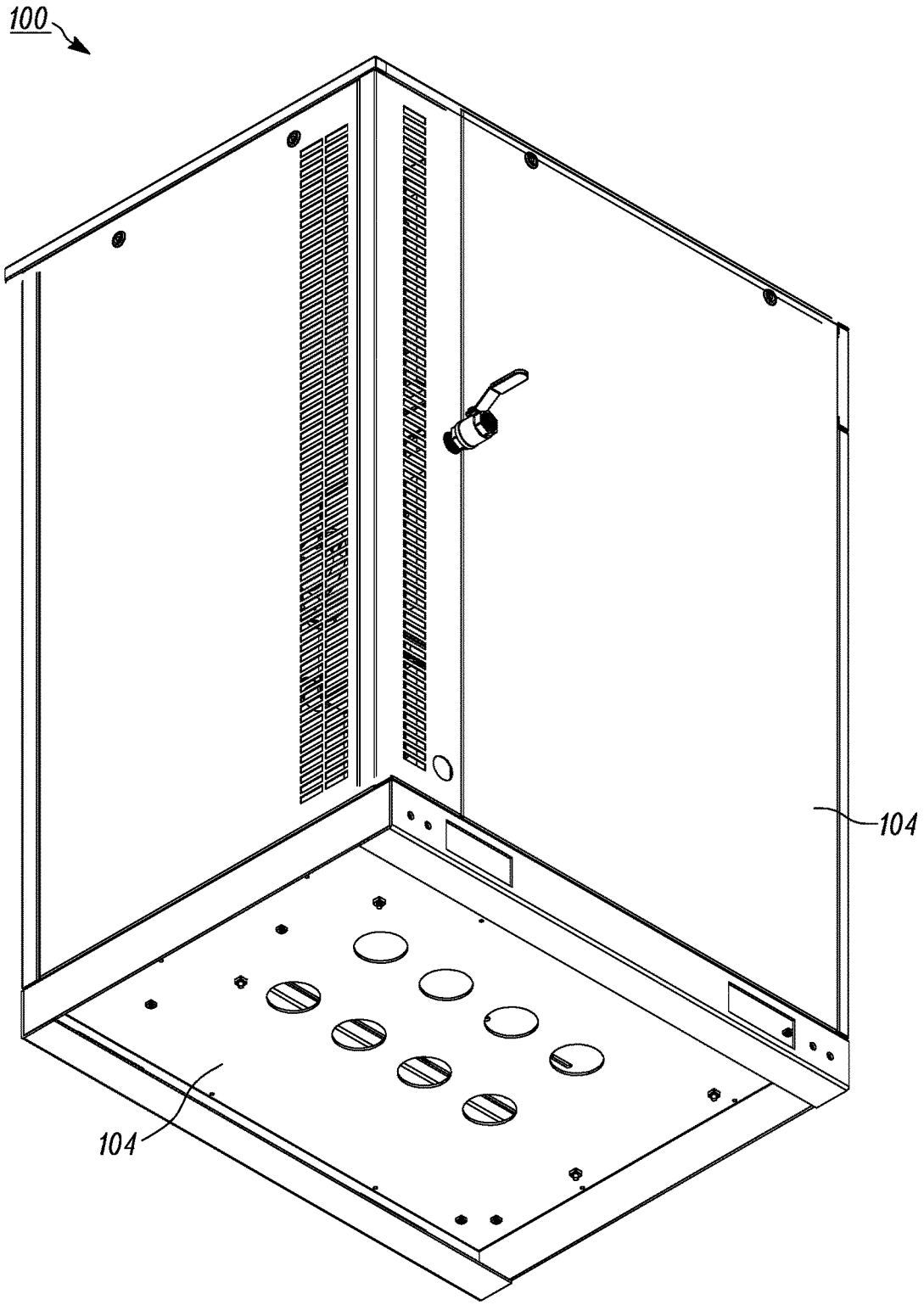
FIG. 1 is a bottom left perspective view of a compressor system constructed in accordance with one example embodiment of the present disclosure.
Figure 2:
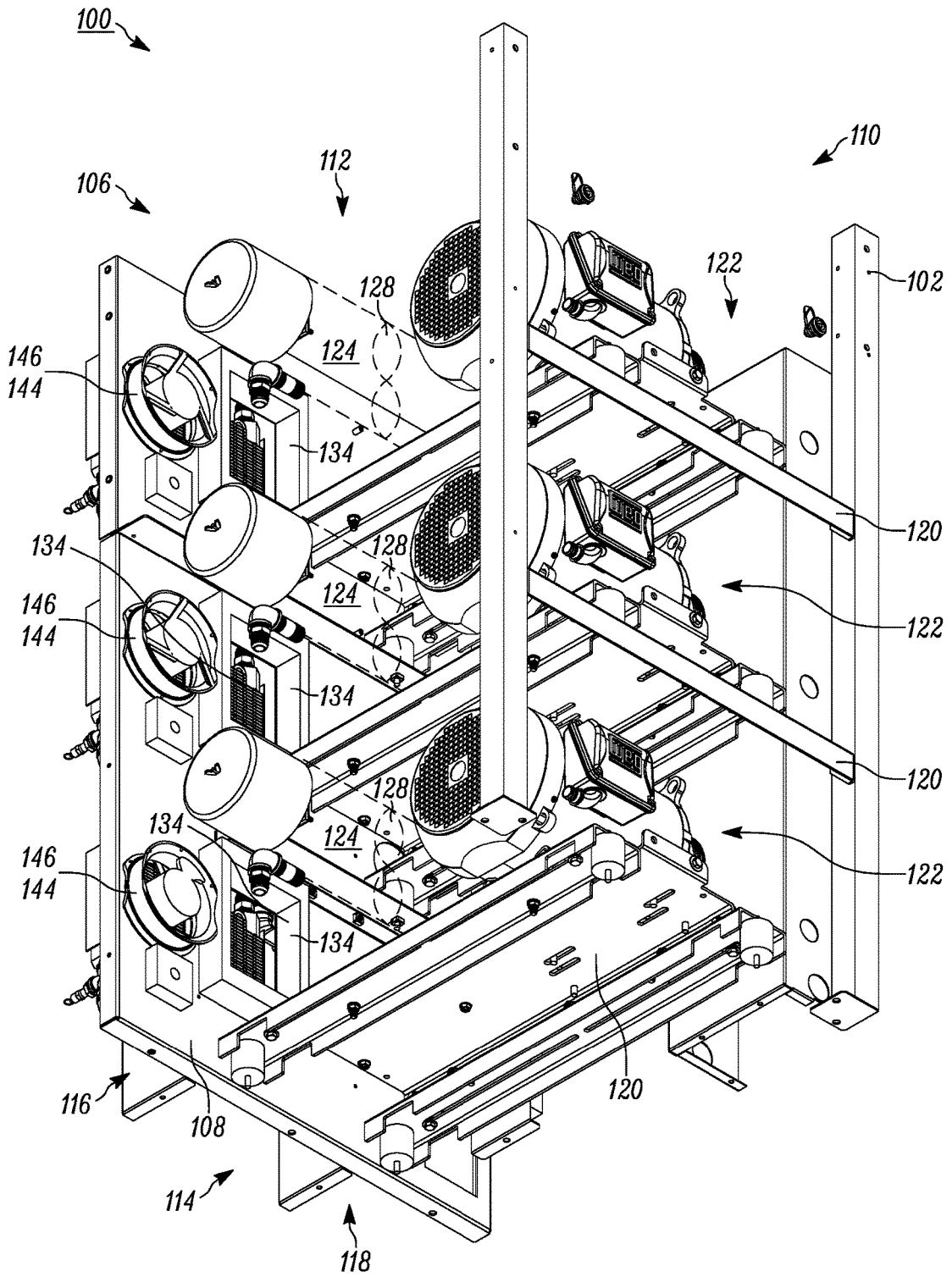
FIG. 2 is a bottom right perspective view of FIG. 1 with exterior panels removed.
Figure 3:
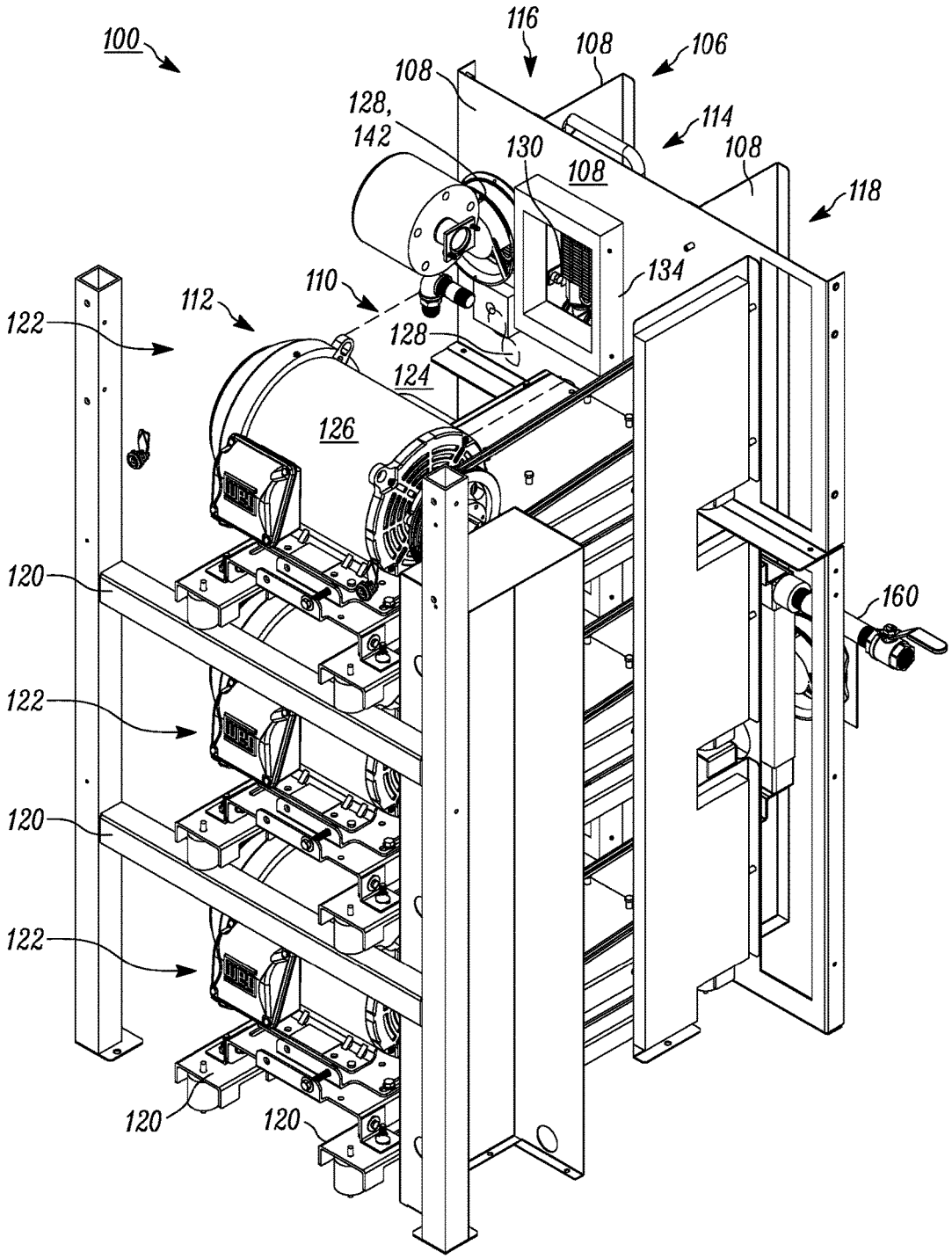
FIG. 3 is top left perspective view of FIG. 1 with exterior panels removed.
Figure 4:
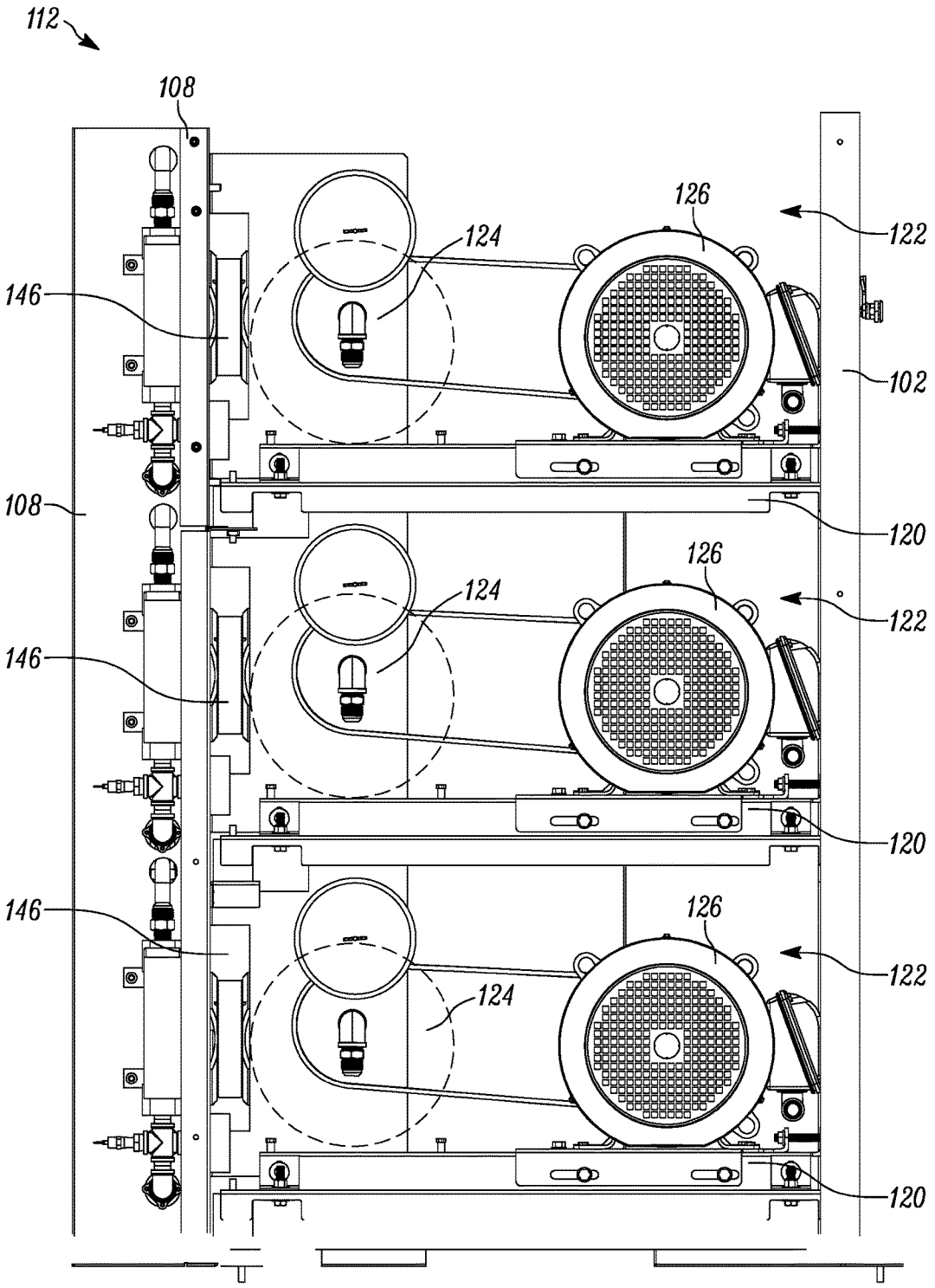
FIG. 4 is a right side view of FIG. 1 with exterior panels removed.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to a compressor system. More specifically, the present disclosure relates to a gas compressor system having a three stage after cooling arrangement that substantially reduces the temperature of a gas after compression.

Referring to FIGS. 1-7, a first example embodiment of a compressor system 100 is shown. The compressor system 100 includes a frame 102 and a plurality of exterior panels 104 attached to the frame 102 to define an enclosure 106. In one example embodiment, the frame 102 and panels 104 are made from metal. In another example embodiment, the frame 102 and/or panels are made from steel or a polymer having similar strength, such as rigid plastic. The compressor system 100 provides compressed gas (e.g. air) used, for example in industry, laboratories, medical fields, and the like.

The enclosure 106 can be a sound reducing enclosure of the type disclosed in U.S. patent application Ser. No. 15/423,255 entitled VACUUM SYSTEM, the entire contents of which are part of this application and incorporated by reference into this document. The enclosure 106 can utilize sound baffles, sound reducing material, and/or other techniques to reduce noise emitted by the compressor system 100. It will be appreciated that any other type of enclosure can be provided.

One or more interior panels 108 are provided in an interior space 110 of the enclosure 106 to divide the enclosure into a compressor bay 112, a first cooling area 114, a second cooling area 116, and a third cooling area 118. The compressor bay 112 includes a plurality of platforms 120 that are mounted to the frame 102. In the illustrated example embodiment, there are three platforms 120. Each platform 120 supports a compressor unit 122 that includes a compressor 124 and a motor 126 driving the compressor. The compressors 124 compress a fluid or gas 101 (see FIG. 5), such as air that is to be regulated to a system outlet temperature based on the gas passage through the cooling areas 114, 116, and 118 as further described herein.

It will be appreciated that this construction results in three total separate compressor units 122. However, it would be appreciated by one having ordinary skill in the art that a fewer or greater amount of compressor units can be provided. In the illustrated example embodiment, the motors 126 are of the substantially same configuration (e.g., have the same horsepower rating, power requirements, etc.) and the compressors 124 are substantially identical oilless scroll compressors. However, it would be appreciated by one having ordinary skill in the art that the compressors 124 can be any other desired compressors, and a different combination of motors and compressors can be provided on each platform. For illustrative purposes, the compressors 124 have been shown in dashed and broken lines.

A fan 128 is provided for each compressor unit 122. The fan 128 can be integral with the compressor unit 122 or separate from the compressor unit. The fans 128 are arranged to provide cooling airflow over the respective compressor 124.

Figure 5:
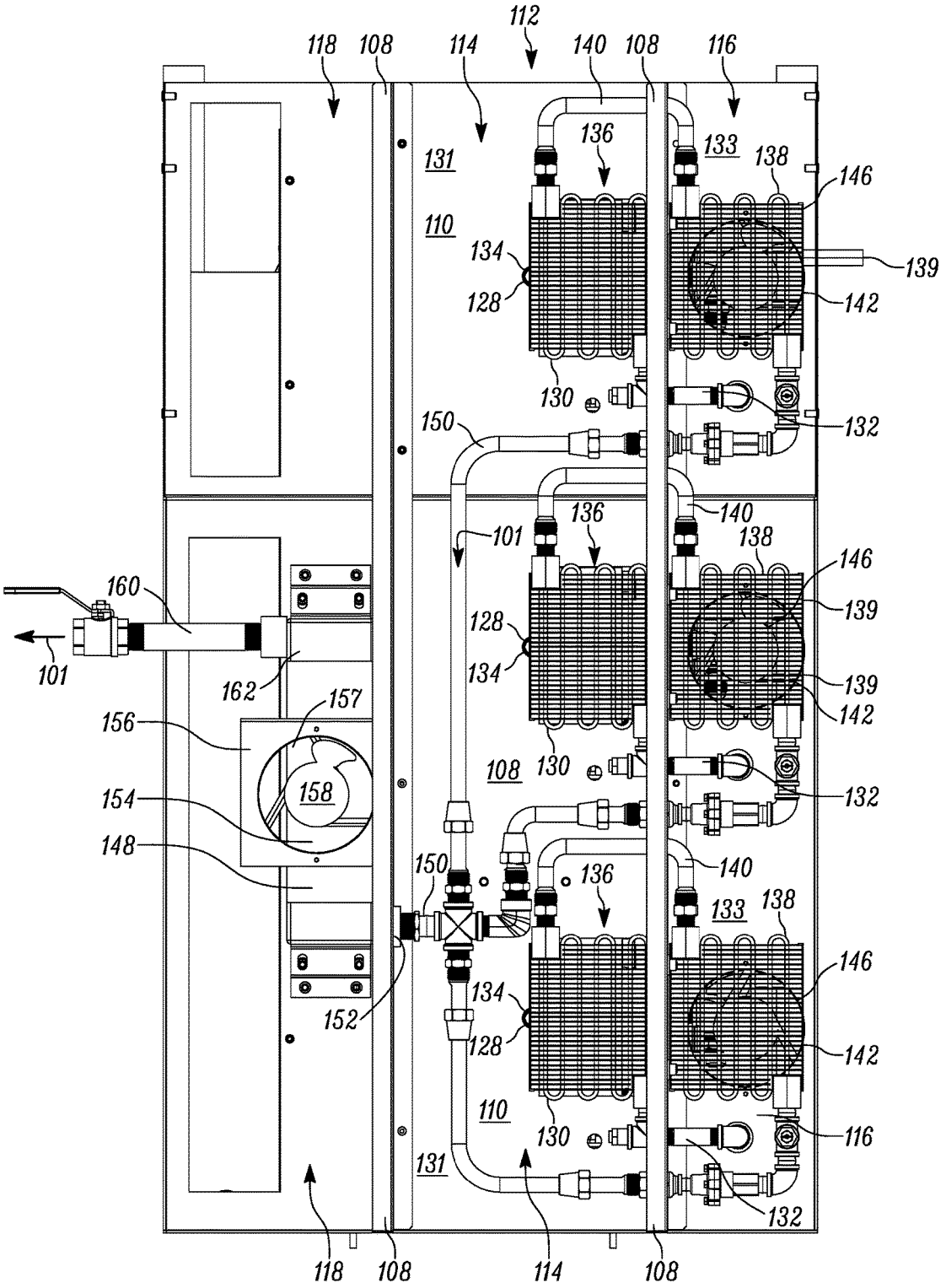
FIG. 5 is a front side view of FIG. 1 with exterior panels removed.
Figure 6:
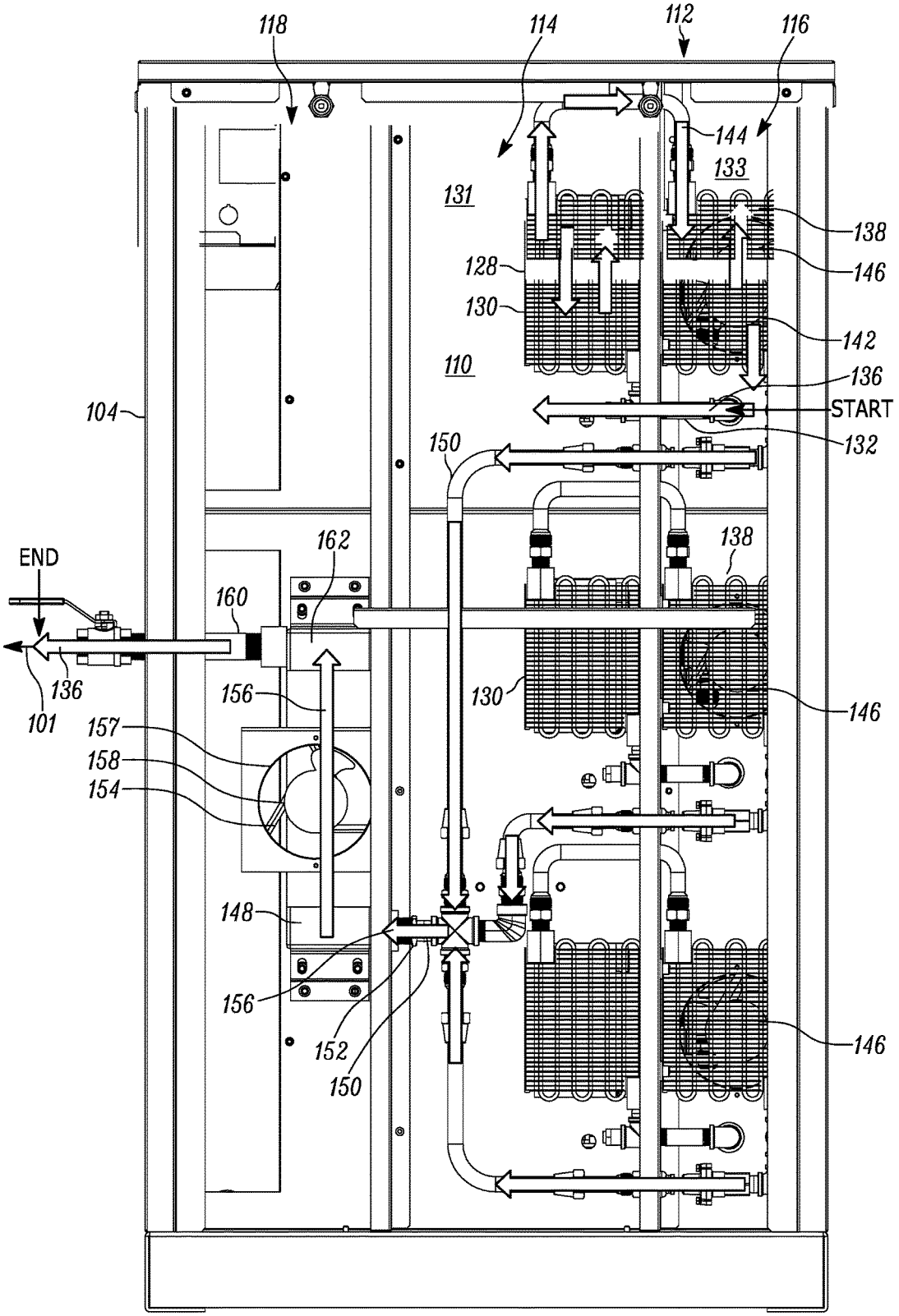
FIG. 6 is a front side view of FIG. 1 showing the path traveled by compressed gas through the compressor system.
Figure 7:
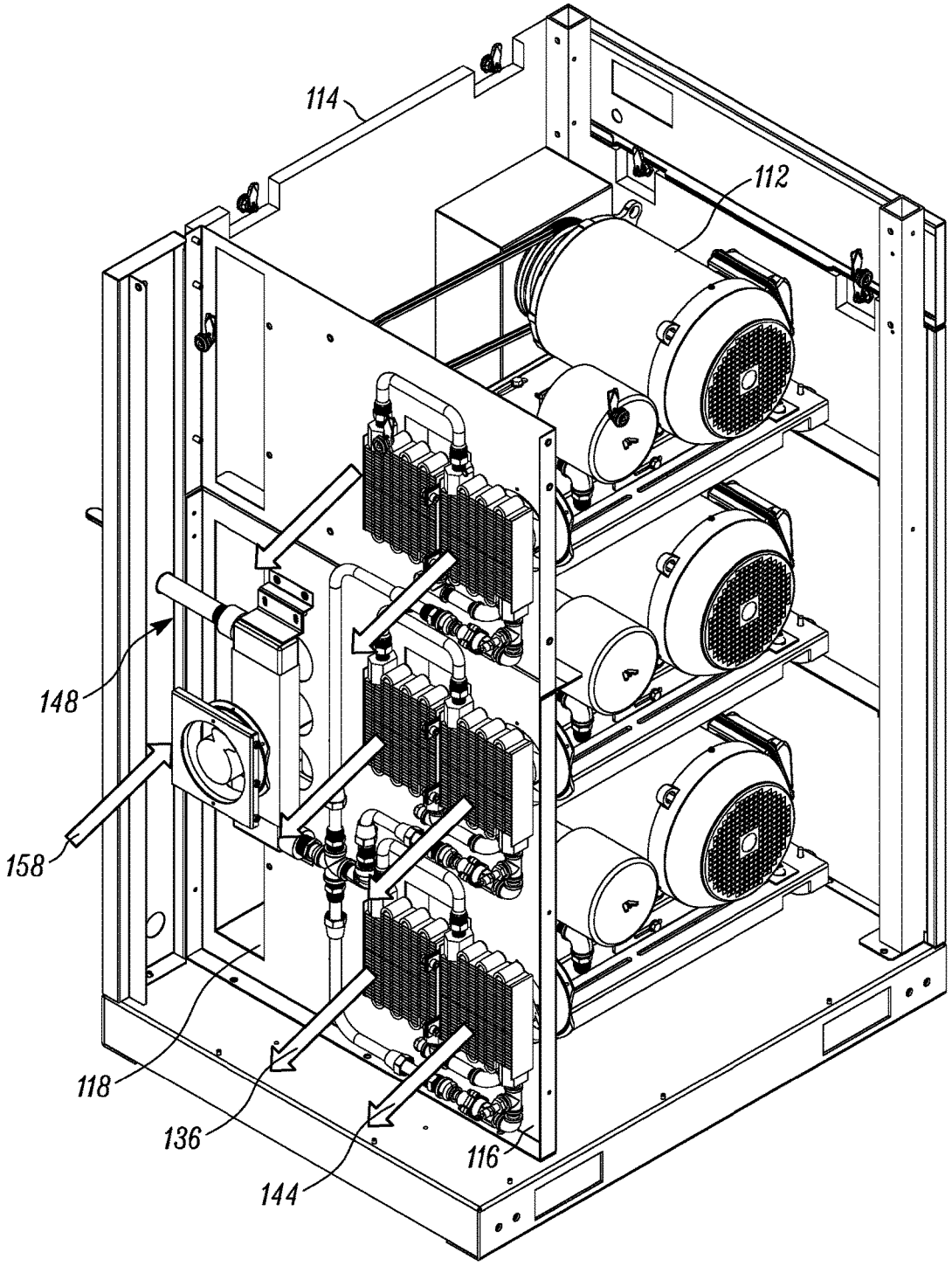
FIG. 7 is a front right perspective view of FIG. 1 showing cooling air flow.
Figure 8:
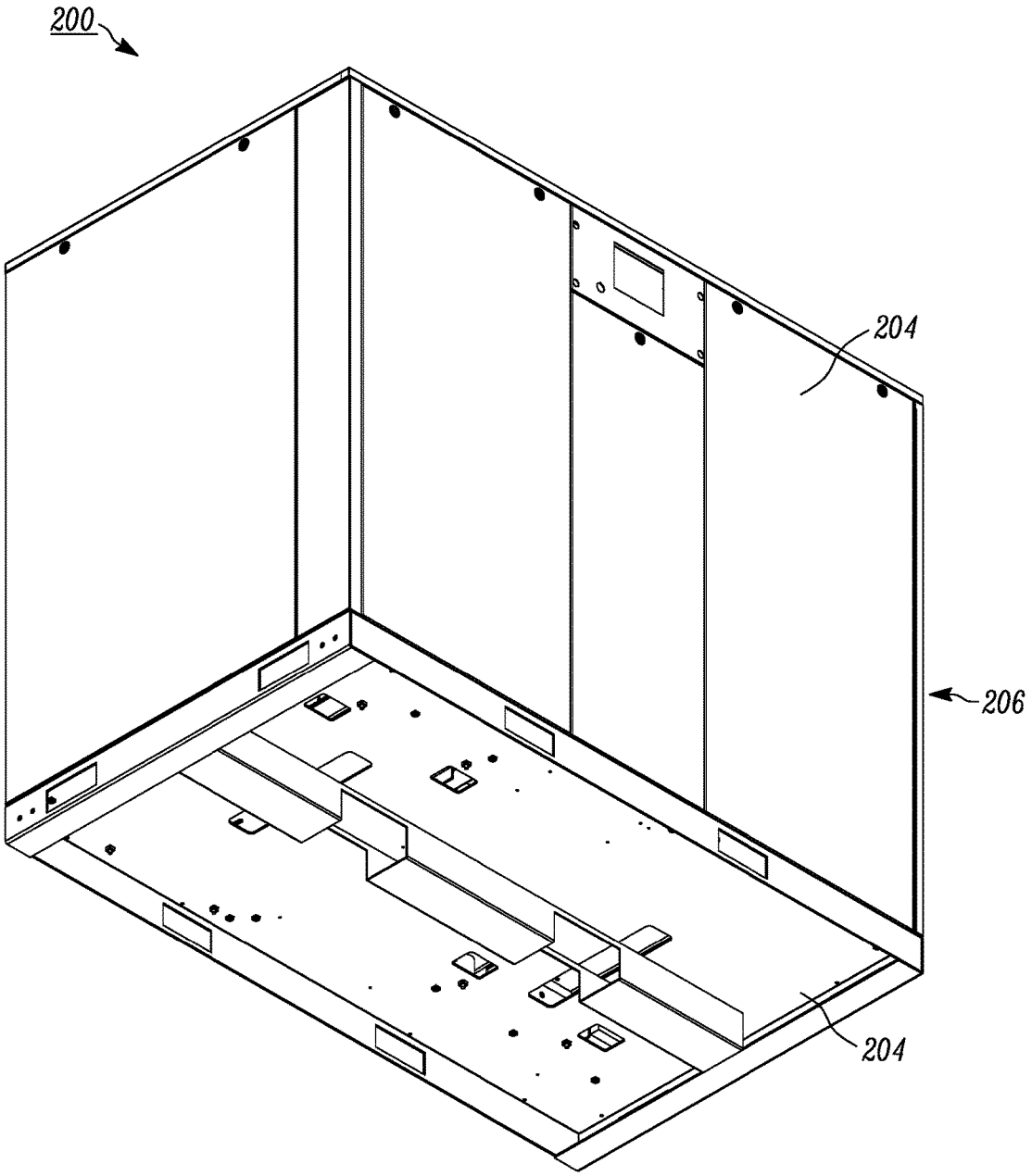
FIG. 8 is a bottom left perspective view of a compressor system constructed in accordance with another example embodiment of the present disclosure.
Figure 9:
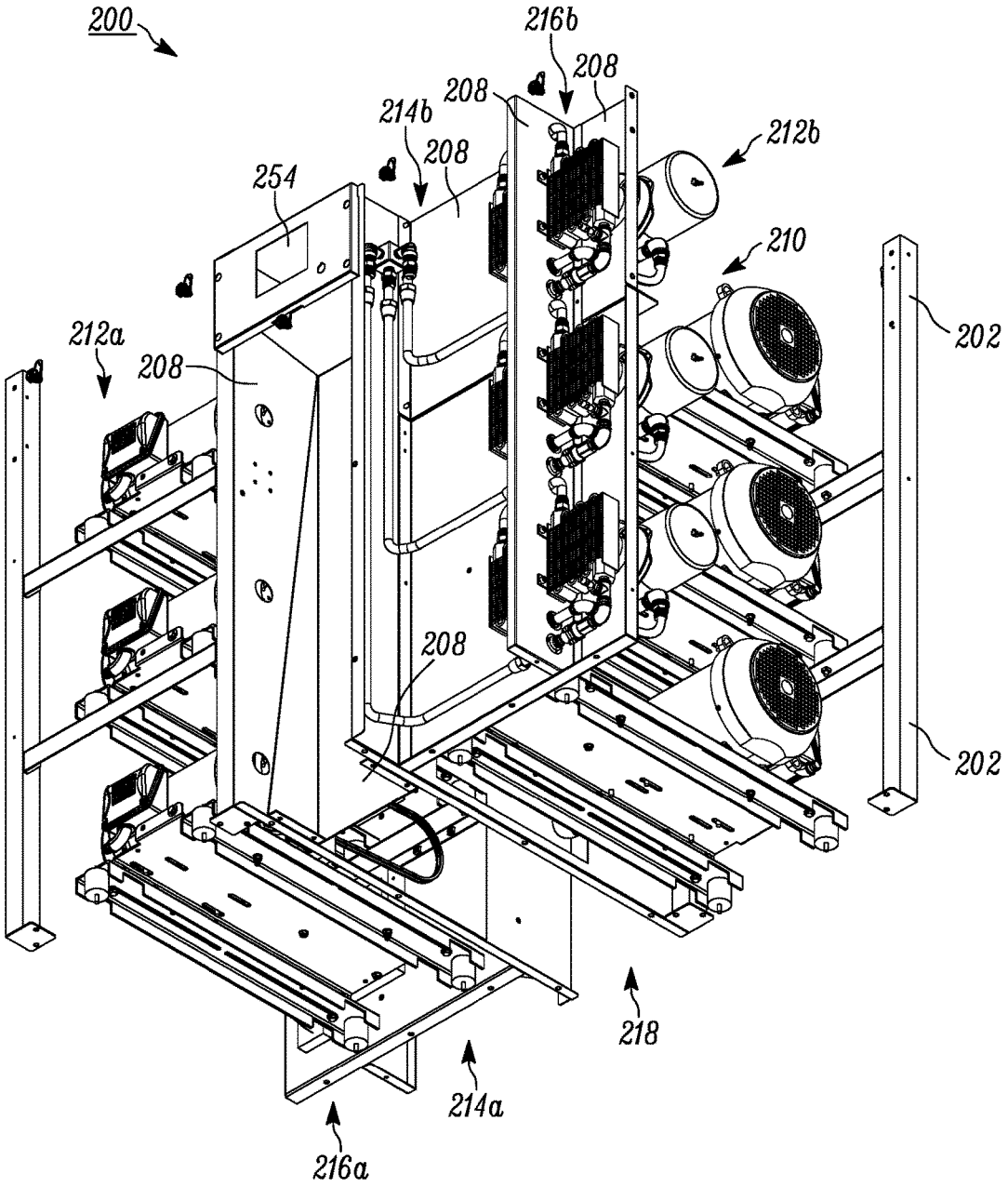
FIG. 9 is a bottom right perspective view of FIG. 8 with exterior panels removed.

As shown in the illustrated example embodiment of FIGS. 5 and 6, the first cooling area 114 houses a plurality of first after coolers 130. In the example embodiment three first after coolers 130 are provided, with one of the three first after coolers being associated with one of the three compressor units 122. A first conduit 132 extends through the interior panels 108 to fluidly couple the first after coolers 130 to the respective compressor units 122. First ducting 134 is provided in the interior space 110 of the enclosure 106 to define a first cooling stage air supply path 136. The first cooling stage air supply path 136 defines a fluid path that extends between the compressor bay 112 and the first cooling area 114.

The second cooling area 116 houses a plurality of second after coolers 138. In the example embodiment three second after coolers 138 are provided, with one of the three second after coolers being associated with one of the three compressor units 122. Additionally, in the example embodiment, the first after coolers 130 are substantially adjacent the second after coolers 138 and the two are completely separated bodies. However, in other examples embodiments, the first after coolers 130 and the second after coolers 138 can share a single body that is internally divided. In the illustrated example embodiment, the after coolers 130 and 138 comprise a plurality of heat exchanging fins 139 that is coupled to an undulating tube of the conduit 132 and 140.

Second conduit 140 extends (in fluid communication with the first ducting 132 to transport the compressed gas 101) through the interior panels 108 to fluidly couple the second after coolers 138 to an associated one of the first after coolers 130. Second ducting 142 is provided in the interior space 110 of the enclosure 106 to define a second cooling stage air supply path 144. The second cooling stage air supply path 144 defines a fluid path that extends between the interior space 110 of the enclosure 106 other than the compressor bay 112 to the second cooling area 116. A fan 146 is provided in the second ducting 142 to augment airflow along the second cooling stage air supply path 144.

The third cooling area 118 houses a single heat exchanger 148. It will be appreciated that the third cooling area 118 can house a plurality of heat exchangers. Additionally, in other example embodiments, the heat exchanger can be a conduit that is sufficiently long enough to provide a desired cooling effect, or an elongated conduit with cooling fins. Any other suitable cooling arrangement can be provided in the third cooling area 118. Inlet conduit 150 extends through the interior panels 108 to fluidly couple an inlet 152 of the heat exchanger 148 to the second after coolers 138. The third ducting 154 is provided in the enclosure 106 to define a third cooling stage air supply path 156. The third cooling stage air supply path 156 defines a fluid path that extends between a space external to the enclosure 106 (e.g., ambient environment) and the third cooling area 118. A fan 158 is provided in the third ducting 154 to augment airflow along the third cooling stage air supply path 156. Outlet conduit 160 extends from an outlet 162 of the heat exchanger 148 through the exterior panels 104 to provide a fluid path for the compressed gas 101 to a location external to the compressor system 100.

A method of operating of the compressor system shown in FIGS. 1-7 is described below. The motors 126 are energized to drive the compressors 124. The compressors 124 reduce the volume of a desired gas 101, thereby increasing the pressure of the gas. The fan 128 provided to each compressor unit 122 flows compressor cooling air 131 over each compressor 124, thereby cooling the compressors, resulting in an increase of the temperature of the compressor cooling air 131. The now compressed gas travels from each of the compressors 124 to the respective first after coolers 130 via the first conduit 132. The compressor cooling air 131, advanced by the air pump or compressor fan 128 via first ducting 134, is carried from the compressor bay 112 to the first cooling area 114 via the first cooling stage air supply path 136 and directed at the first after coolers 130. The compressor cooling air 131 removes heat from the compressed gas traveling through the first after coolers 130 as the compressor cooling air flows past the first after coolers 130. The compressor cooling air 131 is then conveyed to other areas of the interior space 110 of the enclosure 106 for indirect cooling of other compressor system components. The compressor cooling air 131 is able to accomplish a significant portion of the desired cooling of the compressed gas 101. However, because the compressor cooling air 131 has already been used to cool the compressors, the compressor cooling air can only bring the compressed gas to approximately the temperature of the warmed compressor cooling air. To further reduce the temperature of the compressed gas, the compressed gas 101 is then sent to the second after coolers 138.

The compressed gas 101 travels from each of the first after coolers 130 to the respective second after coolers 138 via the second conduit 140. The fan 146 in the second ducting 142 directs enclosure cooling air 133 from the interior space 110 of the enclosure 106 other than the compressor bay 112 to the second cooling area 116 via the second cooling stage air supply path 144. The enclosure cooling air 133 is directed at the second after coolers 138. The enclosure cooling air further removes heat from the compressed gas traveling through the second after coolers 138 as the enclosure cooling air flows past the second after coolers 138. The enclosure cooling air is then discharged from the enclosure 106. Because the enclosure cooling air 133 is taken from the interior space 110 of the enclosure 106 other than the compressor bay 112, the enclosure cooling air is only slightly warmed by heat radiated from various components inside the enclosure 106. In comparison to the compressor cooling air 131 generated by pump fan 128 and/or the air located in the compressor bay 112, the enclosure cooling air 133 is significantly cooler. As such, the enclosure cooling air 133 is able to further reduce the temperature of the compressed gas. To even further reduce the temperature of the compressed gas 101, the compressed gas is next sent to the final heat exchanger 148. In one example embodiment, the heat exchanger 148 is manufactured by API Heat Transfer under part number BGA-35. Although other heat exchangers could be used without departing from the spirit and scope of the present disclosure.

The compressed gas travels from each of the second after coolers 138 to the heat exchanger 148 via the inlet conduit 150. The fan 158 in the third ducting 154 directs ambient cooling air from outside the enclosure 106 to the third cooling area 118 via the third cooling stage air supply path 156. The ambient cooling air 157 is directed at the heat exchanger 148. The ambient cooling air 157 even further removes heat from the compressed gas traveling through the heat exchanger 148 as the ambient cooling air 157 flows past the heat exchanger 148. The ambient cooling air 157 is then directed into the interior 110 of the enclosure 106. Because the ambient cooling air 157 is taken from outside the enclosure 106, the ambient cooling air 157 is not at all warmed by any of the components inside the enclosure 106. In comparison to the enclosure cooling air 133, the ambient cooling air 157 is significantly cooler. The ambient cooling air 157 is as cool as possible to achieve the best possible final temperature for the compressed gas.

The finally cooled compressed gas 101 exits the outlet 162 of the heat exchanger 148 and flows through the outlet conduit 160. The outlet conduit 160 directs the cooled compressed gas to a further location external to the compressor system 100. The further location can be a dryer for further compressed gas processing (e.g., by removing moisture from the compressed gas) or a distribution system that distributes the compressed gas to a plurality of different work areas. In other example embodiments the further location is any other desired location.

In yet another example embodiment, the system 100 provides stages 114, 116, and 118 that reduces the temperature of the compressed gas from 425° F., to 145° F., to 115° F., respectively. In such example embodiment, the compressed gas 101 exits the system 100 at a temperature of 103° F.

It should be appreciated that the construction and orientation of the compressor system 100 is not limited to the compressor system illustrated and described in FIGS. 1-7. Rather, the compressor system 100 can have any desired construction and orientation so long as the above discussed first, second, and third cooling areas 114, 116, 118 are substantially provided. Specifically, the compressor system 100 can have any desired construction and orientation so long as the following three design criteria are substantially met. The first design criteria is providing a first cooling area 114 that includes at least one first after cooler 130 that cools compressed gas flowing therethrough by using compressor cooling air 131 that is provided from a source of air that has been previously used to cool the compressors 124. The second design criteria is providing a second cooling area 116 that includes at least one second after cooler 138 that cools compressed gas flowing therethrough by using enclosure cooling air that is provided from a source of air from the interior space 110 of the enclosure 106 other than the compressor bay 112 (e.g., air that has not been previously used to cool the compressors 124). The third design criteria is providing a third cooling area 118 that includes at least one heat exchanger 148 that cools compressed gas flowing therethrough by using ambient cooling air that is sourced from a location outside the enclosure 106. It will further be appreciated that, in order to maximize cooling of the compressed gas, the compressed gas is passed through the first after cooler 130, the second after cooler 138, and the heat exchanger 148 in that particular order.

Referring now specifically to FIG. 6, the arrows indicate the passage of the compressed gas 101 through the system 100 and all three stages 114, 116, and 118. In the illustrated example embodiment of FIG. 6, three compressors 124 are provided each providing gas 101 at each respective start point (indicated by "Start" for the top compressor) and undulatingly flows through the respective first heat exchanger or after cooler 130 of the first stage 114 (shown in detail for the top compressor although the same for the middle and bottom compressed gas flows). The compressed gas 101 then enters the second stage 116 undulatingly flowing through each respective second heat exchanger or after cooler 138 (shown in detail for the top compressor although the same for the middle and bottom compressed gas flows). Then the gas 101 flow from all three compressors 124 converge to a single union coupling as the combined compressed gases 101 from each compressor now in fluid communication with each other proceed collectively into the third stage 118. Once in the third stage, the combined gases 101 pass through a single last heat exchanger or after cooler 148 before exiting the system at the point END.

Referring now to FIGS. 8-13, a second example embodiment of a compressor system 200 is shown. Features of the compressor system 100 illustrated in FIGS. 1-7 that are similar to the features of the compressor system 200 illustrated in FIGS. 8-13 will be identified by like numerals increased by a factor of one-hundred. The compressor system 200 includes a frame 202 and a plurality of exterior panels 204 attached to the frame 202 to define an enclosure 206. The enclosure 206 can be a sound reducing enclosure of the type disclosed in U.S. patent application Ser. No. 15/423,255 entitled VACUUM SYSTEM, the entire contents of which are incorporated herein by reference. The enclosure 206 can utilize sound baffles, sound reducing material, and/or other techniques to reduce noise emitted by the compressor system 200. It will be appreciated that any other type of enclosure can be provided.

Interior panels 208 are provided in an interior space 210 of the enclosure 206. The interior panels 208 divide the enclosure 206 into a first compressor bay 212*a* and a second compressor bay 212*b*. The interior panels 208 further divide the enclosure 206 into two separate first cooling areas 214*a*, 214*b*, two separate second cooling areas 216*a*, 216*b*, and a third cooling area 218. One of the two first cooling areas 214*a*, 214*b* is associated with the first compressor bay 212*a* and the other of the two first cooling areas is associated with the second compressor bay 212*b*, respectively. Similarly, one of the two second cooling areas 216*a*, 216*b* is associated with the first compressor bay 212*a* and the other of the two second cooling areas is associated with the second compressor bay 212*b*, respectively. Each compressor bay 212 includes three platforms 220 that are mounted to the frame 202. Each platform 220 supports a compressor unit 222 that includes a compressor 224 and a motor 226 driving the compressor. It will be appreciated that this construction results in six separate compressor units 222. However, in other example embodiments a fewer or greater amount of compressor units can be provided. In the example embodiment the motors 226 are of the substantially same configuration (e.g., have the same horsepower rating, power requirements, etc.) and the compressors 224 are substantially identical oilless scroll compressors. However, the compressors can be any other desired compressors, and a different combination of motors and compressors can be provided on each platform. A fan 228 is provided for each compressor unit 222. The fan 228 are one of integral with the compressor unit 222 or separate from the compressor unit. The fans 228 are arranged to provide cooling airflow over the respective compressor 224.

Figure 10:
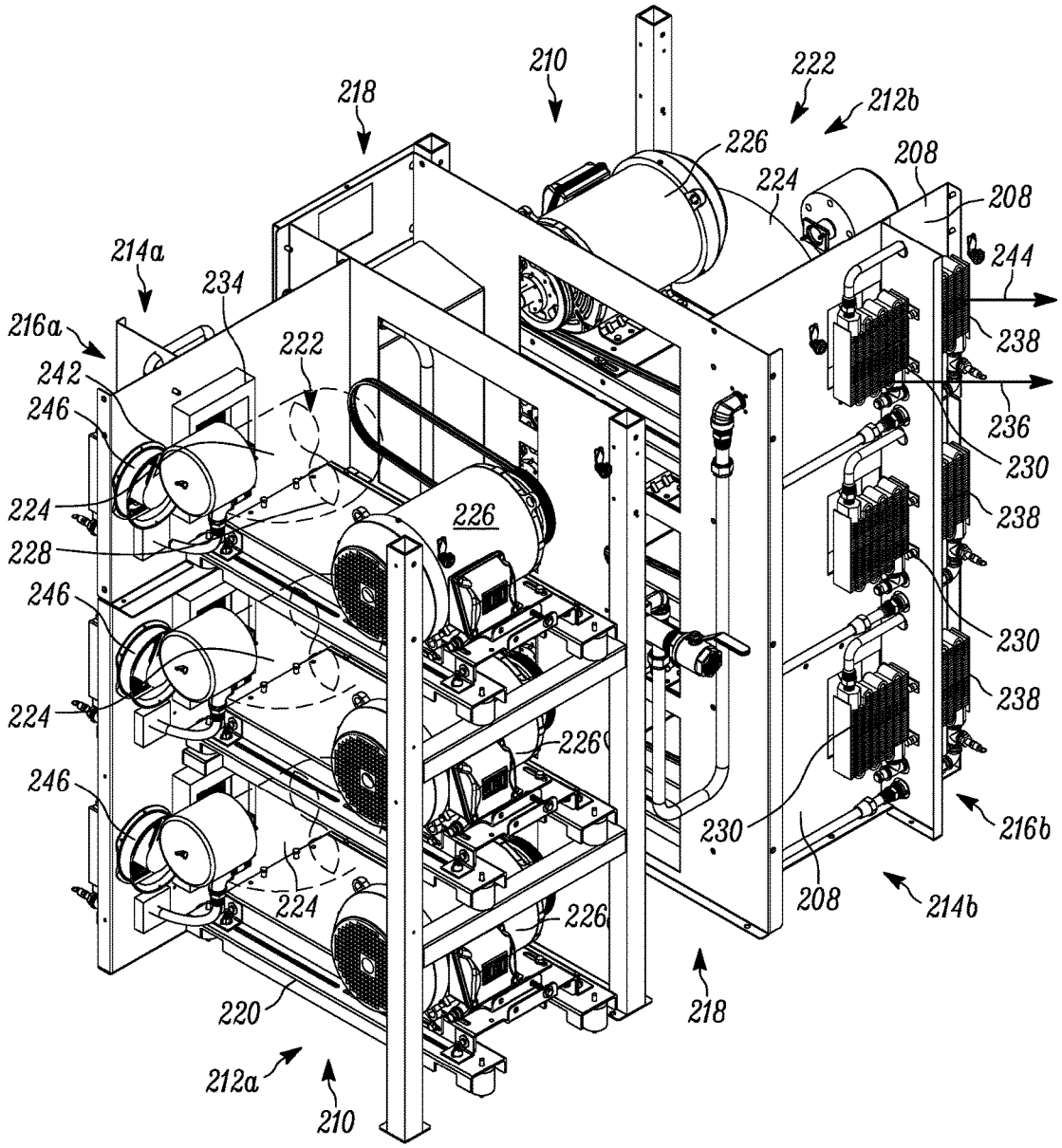
FIG. 10 is left top perspective view of FIG. 8 with exterior panels removed.
Figure 11:
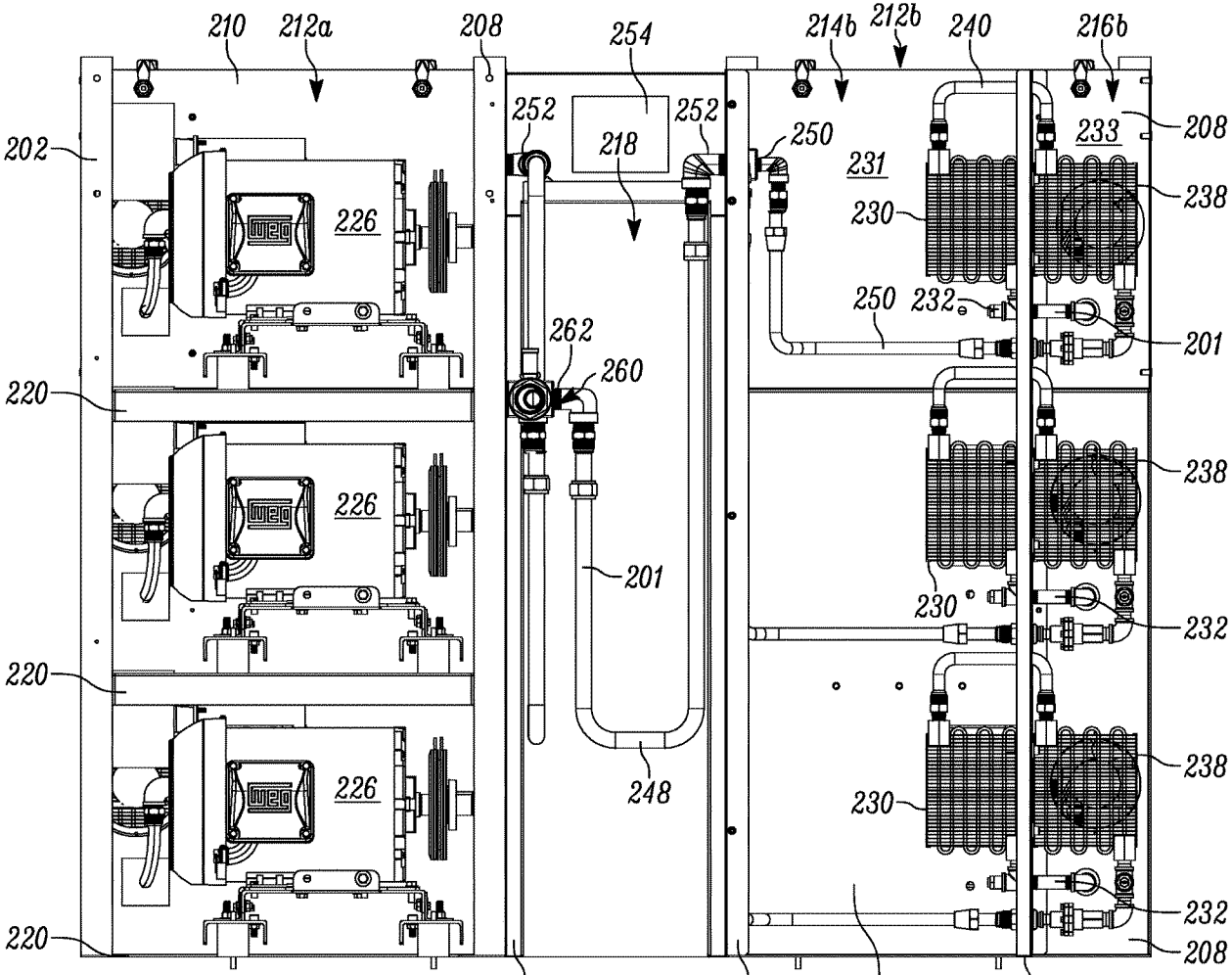
FIG. 11 is a left side view of FIG. 8 with exterior panels removed.
Figure 12:
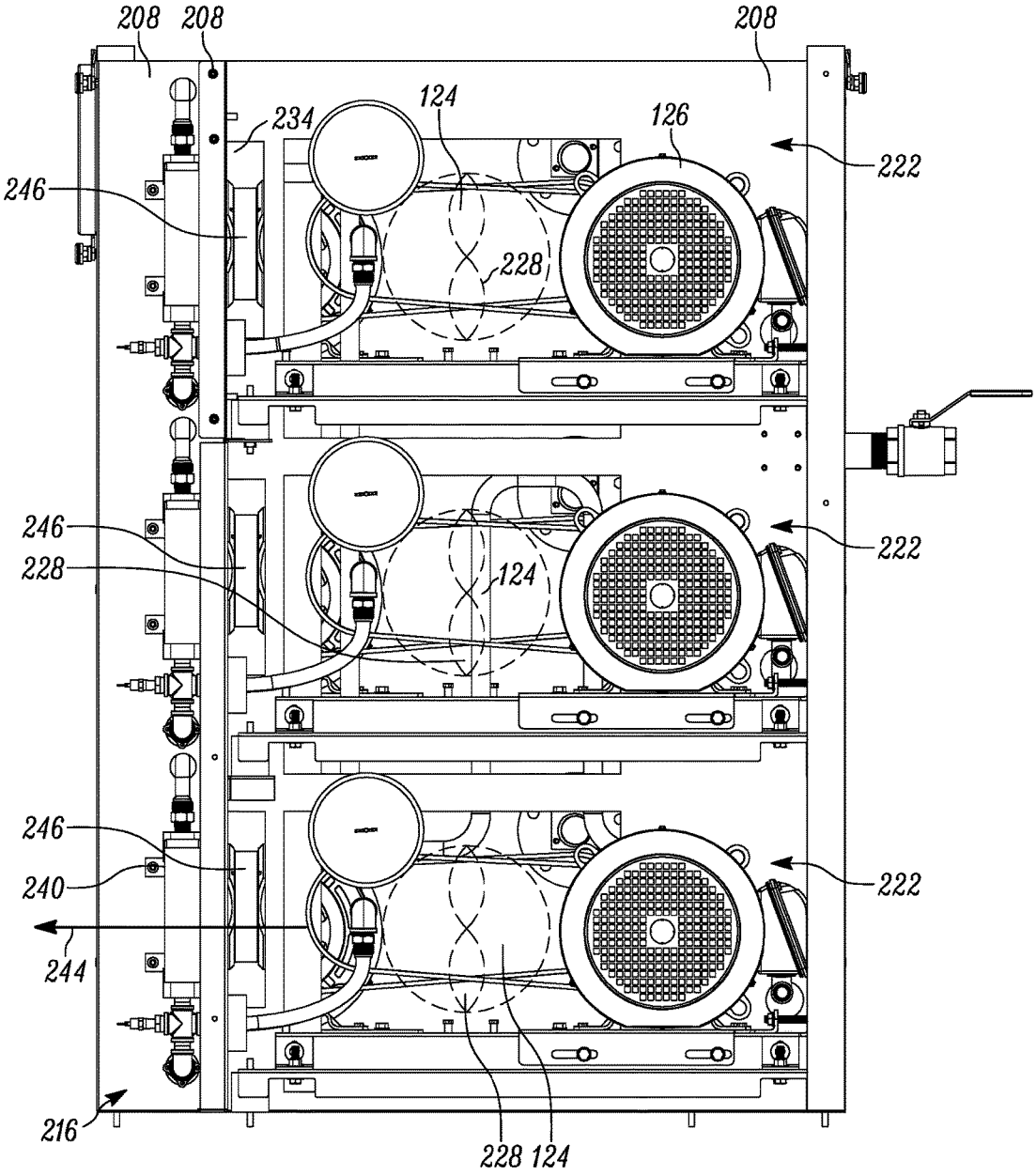
FIG. 12 is front side view of FIG. 8 with exterior panels removed.
Figure 13:
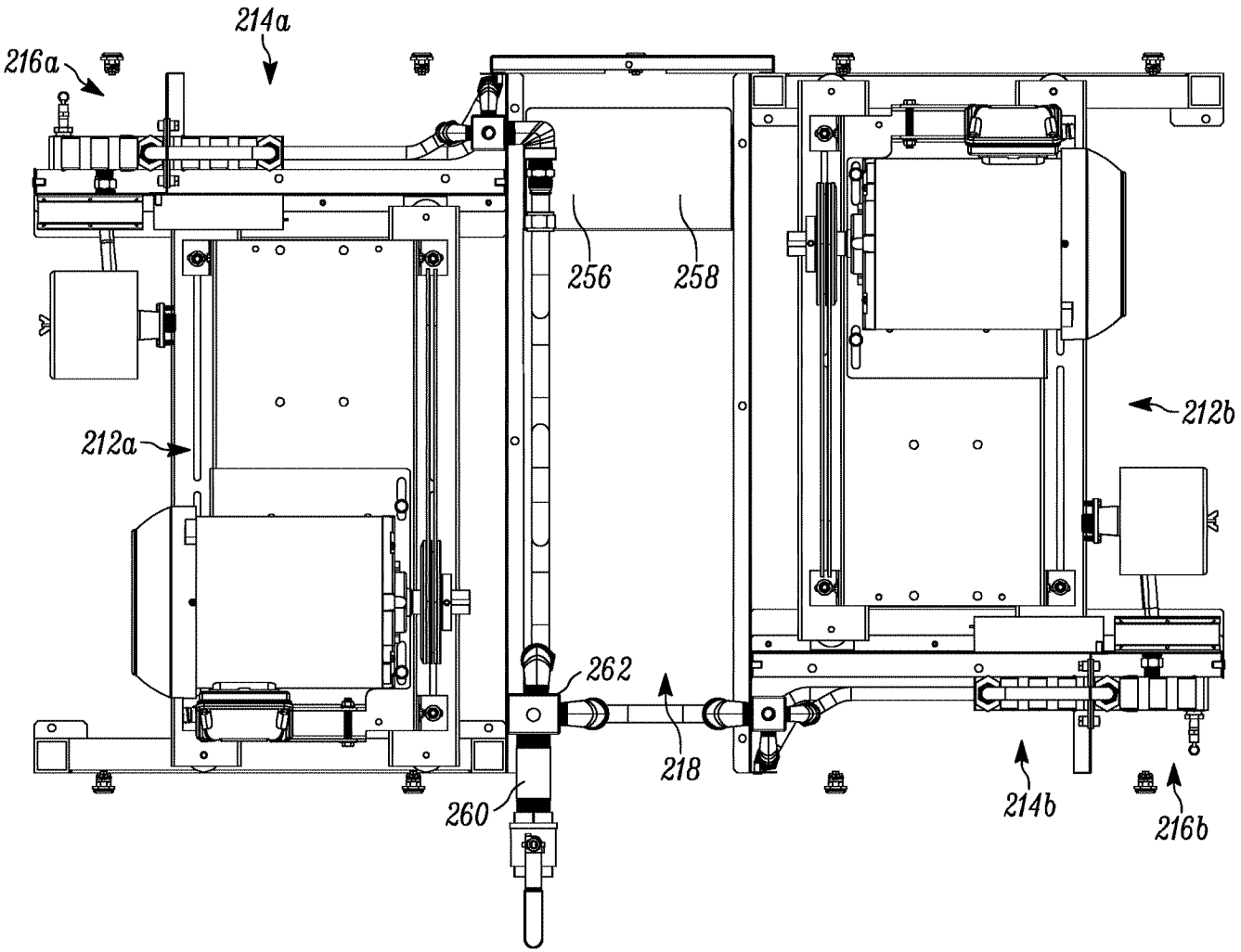
FIG. 13 is a top plan view of FIG. 8 with exterior panels removed.

Each of the first cooling areas 214 house a plurality of first after coolers 230 (see FIG. 11). In the illustrated example embodiment of FIG. 10-11, three first after coolers 230 are provided in each of the first cooling areas 214, with one of the three first after coolers being associated with one of the three compressor units 222. First conduit 232 extends through the interior panels 208 to fluidly couple the first after coolers 230 to the respective compressor units 222. First ducting 234 (see FIG. 10) is provided in the interior space 210 of the enclosure 206 to define a first cooling stage air supply path 236. The first cooling stage air supply path 236 defines a fluid path that extends between the compressor bay 212 and the first cooling area 214.

Each of the second cooling areas 216 houses a plurality of second after coolers 238. In the example embodiment three second after coolers 238 are provided in each of the second cooling areas 216, with one of the three second after coolers being associated with one of the three compressor units 222 provided in the respective compressor bays 212. Additionally, in the illustrated example embodiment, the first after coolers 230 are substantially adjacent the second after coolers 238 and the two are completely separated bodies. However, in other examples embodiments, the first after coolers 230 and the second after coolers 238 share a single body that is internally divided. Second conduits 240 extend through the interior panels 208 to fluidly couple the second after coolers 238 to an associated one of the first after coolers 230 (see FIG. 12). Second ducting 242 is provided in the interior space 210 of the enclosure 206. The second ducting 242 defines a second cooling stage air supply path 244 to each of the first and second cooling areas 216*a*, 216*b* (see FIG. 10). The second cooling stage air supply path 244 defines a fluid path that extends between the interior space 210 of the enclosure 206 other than the compressor bays 212 to the second cooling areas 216. A fan 246 (see FIG. 10) is provided in the second ducting 242 to augment airflow along the second cooling stage air supply path 244.

The third cooling area 218 houses cooling conduit 248. The cooling conduit 248 includes conduit arranged to provide a serpentine like path (e.g., a path with many curves) through the third cooling area. In other example embodiments, the third cooling area 218 can house one or more heat exchangers, or cooling conduits having cooling fins. Any other suitable cooling arrangement can be provided in the third cooling area 218. An inlet conduit 250 extends through the interior panels 208 to fluidly couple an inlet 252 of the cooling conduit 248 to the second after coolers 238 (see FIG. 12). Third ducting 254 is provided in the interior space of the enclosure 206 to define a third cooling stage air supply path 256 (see FIGS. 9 and 13). The third cooling stage air supply path 256 defines a fluid path that extends between a space external to the interior space of the enclosure 206 (e.g., ambient environment) and the third cooling area 218. A fan 258 is provided in the third ducting 254 to augment airflow along the third cooling stage air supply path 256 (see FIG. 13). The cooling conduit 248 (see FIG. 11) terminates in a common junction 262 that combines the compressed gas from the first compressor bay 212*a* and the compressed gas from the second compressor bay 212*b*. An outlet conduit 260 extends from the common junction 262 through the exterior panels 204 to provide a fluid path for the compressed gas to a location external to the compressor system 200.

A method of operation of the compressor system shown in FIGS. 8-13 is described below. Operation of the compressor system 200 shown in FIGS. 8-13 is substantially similar to the operation of the compressor system 100 shown in FIG. 1-7. The motors 226 of the compressor bays 212 are energized to drive the associated compressors 224. The compressors 224 of the compressor bay 212 compress the desired gas into a smaller volume, thereby increasing the pressure of the gas. The fans 228 provided to each compressor unit 222 of the compressor bays 212 flows compressor cooling air 231 over each compressor, thereby cooling the compressors and resulting in an increase of the temperature of the compressor cooling air. As shown in the illustrated example embodiment of FIGS. 10-11, the now compressed gas 201 travels from each of the compressors 224 of the second compressor bays 212*b* to the respective first after coolers 230 of the associated second cooling area 214*b* via the first conduit 232. As further shown in the illustrated example embodiment of FIGS. 10-11, the compressor cooling air 231 is carried from the second compressor bay 212*b* to the associated second cooling area 214*b* via the cooling stage air supply path 236 through the first conduit 232 and directed at the first after coolers 230 of the second cooling area 214*b*. The compressor cooling air removes heat from the compressed gas 201 traveling through the first after coolers 230 as the compressor cooling air 231 flows past the first after coolers 230 of the second cooling area 214*b*. The compressor cooling air 231 is then conveyed to other areas of the interior space 210 of the enclosure 206 for indirect cooling of other compressor system components. The compressor cooling air 231 is able to accomplish a significant portion of the desired cooling of the compressed gas. However, because the compressor cooling air 231 has already been used to cool the compressors 224, the compressor cooling air can only bring the compressed gas to approximately the temperature of the warmed compressor cooling air. To further reduce the temperature of the compressed gas, the compressed gas is then sent to the second after coolers 238.

As shown in the illustrated example embodiment of FIGS. 10-11, the compressed gas travels from each of the first after coolers 230 to the respective second after coolers 238 via the second conduit 240. The fan 246 in the second ducting 242 directs enclosure cooling air 233 from the interior space 210 of the enclosure 206 other than the compressor bays 212 to the second cooling areas 216 via the second cooling stage air supply paths 244. The enclosure cooling air 233 is directed at the second after coolers 238. The enclosure cooling air 233 further removes heat from the compressed gas traveling through the second after coolers 238 as the enclosure cooling air flows past the second after coolers 238. The enclosure cooling air 233 is then discharged from the enclosure 206. Because the enclosure cooling air 233 is taken from the interior space 210 of the enclosure 206 other than the compressor bays 212, the enclosure cooling air is only slightly warmed by heat radiated from various components inside the enclosure 206. In comparison to the compressor cooling air 231, the enclosure cooling air 233 is significantly cooler. As such, the enclosure cooling air 233 is able to further reduce the temperature of the compressed gas. To even further reduce the temperature of the compressed gas, the compressed gas is next sent to the cooling conduit 248.

The compressed gas travels from the second after coolers 238 to the cooling conduit 248 via the third conduit 250. The fan 258 in the third ducting 254 directs ambient cooling air from outside the enclosure 206 to the third cooling area 218 via the third cooling stage air supply path 256 (see FIGS. 11 and 13). The ambient cooling air is directed the serpentine like cooling conduit 248 (see FIG. 11). The ambient cooling even further removes heat from the compressed gas traveling through the cooling conduit 248 as the ambient cooling air flows past cooling conduit 248. The ambient cooling air is then directed into the interior 210 of the enclosure 206. Because the ambient cooling air is taken from outside the enclosure 206, the ambient cooling air is not at all warmed by any of the components inside the enclosure 206. In comparison to the enclosure cooling air 233, the ambient cooling air is significantly cooler. The ambient cooling air is as cool as possible to achieve the best possible final temperature for the compressed gas. Additionally, due to the serpentine like nature of the cooling conduit 248, the time that the compressed gas remains in the third cooling area 218 is maximized in order to further achieve the best possible compressed gas final temperature.

Although the above description primarily discusses the second compressor bay 212*b* and subsequent cooling processes associated with the second compressor bay 212*b*, it is understood that the same process is being executed simultaneously in the first compressor bay 212*a* and subsequent cooling processes in regard to gas compression and compressed gas cooling. Additionally, it will be appreciated that one or more compressors of either the first compressor bay 212*a* or the second compressor bay 212*b* can be operated while the other compressor bay is down for maintenance, repair, etc.

As shown in the illustrated example embodiment of FIG. 11, the compressed gas 201 from the first compressor bay 212*a* and the compressed gas from the second compressor bay 212*b* merge and intermix at the common junction 262. From the common junction 262, the now intermixed compressed gas flows through the outlet conduit 260 where the cooled compressed gas is directed to a further location external to the compressor system 200. The further location can be a dryer for further compressed gas processing (e.g., for removing moisture from the compressed gas) or a distribution system that distributes the compressed gas to a plurality of different work areas. In other example embodiments the further location is any other desired location.

Again, it will be appreciated that the construction and orientation of the compressor system 200 is not limited to the compressor system illustrated and described in FIGS. 8-13. Rather, the compressor system 200 can have any desired construction and orientation so long as the above discussed first, second, and third cooling areas 214, 216, 218 are substantially provided. Specifically, the compressor system 200 can have any desired construction and orientation so long as the following three design criteria are substantially met. The first design criteria is providing a first cooling area 214 that includes at least one first after cooler 230 that cools compressed gas 201 flowing therethrough by using compressor cooling air 231 that is provided from a source of air that has been previously used to cool the compressors 224. The second design criteria is providing a second cooling area 216 that includes at least one second after cooler 238 that cools compressed gas 201 flowing therethrough by using enclosure cooling air 233 that is provided from a source of air from the interior space 210 of the enclosure 206 other than the compressor bay 212 (e.g., air that has not been previously used to cool the compressors 224). The third design criteria is providing a third cooling area 218 that includes at least one heat exchanger 248 that cools compressed gas 201 flowing therethrough by using ambient cooling air that is sourced from a location outside the enclosure 206. It will further be appreciated that, in order to maximize cooling of the compressed gas 201, the compressed gas is passed through the first after cooler 230, the second after cooler 238, and the heat exchanger 248 in that particular order.

Several advantages are realized by the above described compressor systems. First, the exterior panels 104, 204 that define the enclosure reduce noise emitted by the compressor system 100, 200. Second, the compressor system 100, 200 of the present invention is able to provide compressed gas 101, 201 at a much lower temperature as compared to known enclosed compressor systems. Third, because the first after cooler 130, 230 substantially reduces the temperature of the compressed gas 101, 201, the size of the second after cooler 138, 238 and associated fan 146, 246 can be minimized to reduce size, space, and power requirements. Fourth, because two after coolers are utilized before the compressed gas 301 is cooled by the heat exchanger/cooling conduit 148, 248, the bulk of the heat load is eliminated prior to the compressed gas 201 entering the heat exchanger/cooling conduit. As such, ambient cooling air passing over the heat exchanger/cooling conduit 148, 248 is not significantly warmed before passing to the enclosure 110, thereby providing cooler air to the components contained therein. It will be appreciated that other advantages not specifically described herein are provided by the compressor systems 100, 200 described above.

In the foregoing specification, specific embodiments have been described. However, one of ordinary skill in the art appreciates that various modifications and changes can be made without departing from the scope of the disclosure as set forth in the claims below. For example, additional after coolers and heat exchangers (e.g., more after coolers or heat exchangers for each cooling area, additional cooling areas, etc.) can be provided to alter the final temperature of the compressed gas. As another example, greater or fewer fans can be provided to obtain a desired air flow in the enclosure. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected or in contact, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A compressor system comprising:

a plurality of panels attached to a frame to define an enclosure;

a pump bay provided in the enclosure, the pump bay including a motor and a compressor driven by the motor; and interior panels defining the pump bay, a first cooling area comprising a first after cooler, a second cooling area comprising a second after cooler, and a third cooling area comprising a heat exchanger, the interior panels comprising ducting to fluidly connect at least one of the pump bay, the first cooling area, the second cooling area, and the third cooling area to each other.

2. The compressor system of claim 1, comprising a conduit extending through the interior panels to provide a fluid path for compressed gas from the compressor, the first after cooler, the second after cooler, and the heat exchanger.

3. The compressor system of claim 1, wherein the ducting comprises a first ducting to provide fluid communication between the pump bay and the first after cooler.

4. The compressor system of claim 1, wherein the ducting comprises a second ducting to provide fluid communication between an interior space of the enclosure and the second after cooler.

5. The compressor system of claim 1, wherein the ducting comprises a third ducting to provide fluid communication between an ambient environment external to the enclosure and the heat exchanger.

6. The compressor system of claim 1, wherein the compressor is an oilless scroll compressor.

7. The compressor system of claim 1, wherein a fan is provided for augmenting airflow through at least one of the first ducting, the second ducting, and the third ducting.

8. The compressor system of claim 1, wherein the compressor outputs compressed air into a first conduit that is coupled to the first after cooler, the first conduit travels through the interior panel separating the pump bay from the first cooling bay.

9. The compressor system of claim 1, wherein the first after cooler outputs compressed air into a second conduit that is coupled to the first after cooler and the second after cooler, the second conduit travels through the interior panel separating the first cooling bay from the second cooling bay.

10. The compressor system of claim 1, wherein the second after cooler outputs compressed air into a third conduit that is coupled to the second after cooler and the heat exchanger, the third conduit travels through the interior panel separating the second cooling bay from the third cooling bay.

11. The compressor system of claim 1, wherein the heat exchanger outputs compressed air into a fourth conduit that is coupled to the heat exchanger and an output nozzle, the fourth conduit travels through the panel defining the enclosure into the ambient environment external to the enclosure.

12. The compressor system of claim 11, wherein the fourth conduit comprises a serpentine shape.

13. A method of assembling a compressor system comprising the steps of:

attaching a plurality of panels to a frame to define an enclosure;

arranging a plurality of interior panels in the enclosure to define a pump bay, a first cooling bay, a second cooling bay, and a third cooling bay providing a motor and a compressor driven by the motor in the pump bay;

providing a first after cooler in the first cooling bay and fluidly coupling the first after cooler to the compressor;

providing a second after cooler in the second cooling bay and fluidly coupling the first after cooler to the second after cooler; and providing a heat exchanger in the third cooling bay and fluidly coupling the heat exchanger to the second after cooler.

14. The method of claim 13, further comprising forming one or more conduits extending through the interior panels to fluidly couple the compressor, the first after cooler, the second after cooler, and the heat exchanger.

15. The method of claim 13, further comprising forming:

first ducting in the enclosure to provide fluid communication between the pump bay and the first after cooler;

second ducting in the enclosure to provide fluid communication between an interior space of the enclosure and the second after cooler; and third ducting in the enclosure to provide fluid communication between an ambient environment external to the enclosure and the heat exchanger.

16. The method of claim 13, further wherein providing the compressor comprises providing an oilless scroll compressor.

17. The method of claim 13, comprising providing one or more fans for augmenting airflow through at least one of the first ducting, the second ducting, and the third ducting.

18. A compressor system comprising:

a plurality of panels attached to a frame to define an enclosure;

a pump bay provided in the enclosure, the pump bay including a motor and a compressor driven by the motor;

a first after cooler;

a second after cooler;

a heat exchanger;

interior panels arranged in the enclosure to separate the pump bay, the first after cooler, the second after cooler, and the heat exchanger;

conduit extending through the interior panels to provide a fluid path for compressed gas from the compressor, the first after cooler, the second after cooler, and the heat exchanger;

first ducting provided in the enclosure, the first ducting being arranged to provide fluid communication between the pump bay and the first after cooler;

second ducting provided in the enclosure, the second ducting being arranged to provide fluid communication between an interior space of the enclosure and the second after cooler; and third ducting provided in the enclosure, the third ducting being arranged to provide fluid communication between an ambient environment external to the enclosure and the heat exchanger.

19. The compressor system of claim 18, wherein the compressor is an oilless scroll compressor.

20. The compressor system of claim 18, wherein a fan is provided for augmenting airflow through at least one of the first ducting, the second ducting, and the third ducting.

* * * * *